US011473453B1

(12) United States Patent
Perkins et al.

(10) Patent No.: US 11,473,453 B1
(45) Date of Patent: Oct. 18, 2022

(54) INTEGRATED FLYWHEEL AND INTAKE CAM LOBE

(71) Applicant: Southwest Research Institute, San Antonio, TX (US)

(72) Inventors: Anthony Perkins, Shoreham-by-Sea (GB); Riccardo Meldolesi, Hove (GB); Clive Lacy, Worthing (GB); Dustin Kramer, Helotes, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 0 days.

(21) Appl. No.: 17/652,190

(22) Filed: Feb. 23, 2022

(51) Int. Cl.
*F01L 1/04* (2006.01)
*F01L 1/047* (2006.01)
*F02B 75/02* (2006.01)

(52) U.S. Cl.
CPC ..... *F01L 1/047* (2013.01); *F02B 75/02* (2013.01); *F01L 2250/06* (2013.01); *F02B 2075/025* (2013.01)

(58) Field of Classification Search
CPC ..... F01L 1/047; F01L 2250/06; F02B 75/02; F02B 2075/025
See application file for complete search history.

(56) References Cited

U.S. PATENT DOCUMENTS 1,461,348 A * 7/1923 Dickinson ..... F02B 25/00 123/65 VC
RE16,630 E * 5/1927 Nordwick ..... F01B 9/06 123/55.1
3,018,618 A * 1/1962 Williams ..... F01L 13/08 123/179.9
3,570,459 A * 3/1971 Combs ..... F02B 73/00 74/25
7,428,886 B1 * 9/2008 Minculescu ..... F02B 33/14 123/62
2011/0132333 A1 * 6/2011 Proenca ..... F02B 75/042 123/51 R
2013/0276761 A1 * 10/2013 Ho ..... F02B 75/282 123/197.1
2013/0312698 A1 * 11/2013 Mavinahally ..... F02B 41/04 123/197.4
2014/0209054 A1 * 7/2014 Shimizu ..... F16C 7/023 123/197.3
2014/0318483 A1 * 10/2014 Shutlar ..... F01B 1/062 123/55.3
2014/0318518 A1 * 10/2014 Jeswine ..... F01B 1/08 123/73 R
2022/0154604 A1 * 5/2022 Andersson ..... F02B 41/06

* cited by examiner

*Primary Examiner* — Hung Q Nguyen
(74) *Attorney, Agent, or Firm* — Grossman, Tucker, Perreault & Pfleger, PLLC

(57) ABSTRACT

A reciprocating piston engine, comprising an engine block having a piston cylinder; a piston disposed in the piston cylinder; an intake port to the piston cylinder, an intake valve to open and close the intake port to the piston cylinder; a rotatable crankshaft; a flywheel connected to the crankshaft which is rotatable with the crankshaft, the flywheel having a circumferential profile; and a cam lobe forming a portion of the circumferential profile of the flywheel wherein, during rotation of the crankshaft, the cam lobe acts on the intake valve to open the intake valve.

20 Claims, 3 Drawing Sheets

INTEGRATED FLYWHEEL AND INTAKE CAM LOBE

FIELD

The present disclosure relates to an integrated flywheel and intake cam lobe, which may be used for an engine.

BACKGROUND

Analysis and simulation of an expander in a supercritical carbon dioxide ($CO_2$) waste heat recovery system indicated that a short intake valve duration would be required to optimize efficiency.

Achieving such fast valve actuations is challenging for several reasons. One of which is the manufacturing process of the cam itself. A very fast cam requires compromise on either the diameter of the cam base circle, or the radius of curvature of the cam flank. Cam profiles are typically manufactured with a grinding operation. The arc of contact between the grinding wheel and the cam is continually changing as the grinding wheel follows the profile. As the arc of contact increases, more grinding particles come in contact with the workpiece, which reduces the force on each grain resulting in less material removal and makes the sliding and ploughing interactions more dominant. Most cam grinders have a minimum radius of curvature that they can produce. For a short valve duration, it is often necessary to use a large diameter cam base circle to bring the radius of curvature into manufacturing range. A large cam can result in high camshaft toque and packaging difficulties.

SUMMARY

In at least one embodiment, a reciprocating piston engine is provided, which comprises an engine block having a piston cylinder; a piston disposed in the piston cylinder; an intake port to the piston cylinder, an intake valve to open and close the intake port to the piston cylinder; a rotatable crankshaft; a flywheel connected to the crankshaft which is rotatable with the crankshaft, the flywheel having a circumferential profile; and a cam lobe forming a portion of the circumferential profile of the flywheel, wherein, during rotation of the crankshaft, the cam lobe acts on the intake valve to open the intake valve.

In at least one embodiment of the engine, the reciprocating piston engine operates with a pressurized, non-combustible, working fluid.

In at least one embodiment of the engine, the reciprocating piston engine operates with the working fluid introduced to the piston cylinder at a pressure in a range of 150-300 bar. In at least one embodiment of the engine, the working fluid is a supercritical fluid.

In at least one embodiment of the engine, the supercritical fluid is supercritical carbon dioxide.

In at least one embodiment of the engine, the reciprocating piston engine has a two-stroke working cycle having an intake stroke and an exhaust stroke.

In at least one embodiment of the engine, the cam lobe acts on the intake valve to open and/or close the intake valve when the two-stroke working cycle is in the intake stroke.

In at least one embodiment of the engine, the reciprocating piston engine further comprises a crosshead; a piston rod; and a connecting rod; wherein the piston rod connects the piston and the crosshead; and wherein the connecting rod connects the crosshead and the crankshaft.

In at least one embodiment of the engine, the intake valve has a valve stem and a flywheel follower; and wherein the flywheel follower 276 follows the circumferential profile 202 of the flywheel 200 as the flywheel 200 rotates with the crankshaft 130.

In at least one embodiment, a method of operating a reciprocating piston engine is provided, which comprises obtaining the engine, the engine comprising an engine block having a piston cylinder; a piston disposed in the piston cylinder; an intake port to the piston cylinder; an intake valve to open and close the intake port to the piston cylinder; a rotatable crankshaft; a flywheel connected to the crankshaft which is rotatable with the crankshaft, the flywheel having a circumferential profile; and a cam lobe forming a portion of the circumferential profile of the flywheel, wherein, during rotation of the crankshaft, the cam lobe acts on the intake valve to open the intake valve; rotating the crankshaft and the flywheel; opening the intake valve with the cam lobe of the rotating flywheel; introducing a pressurized, non-combustible, working fluid into the piston cylinder while the intake valve is opened; and expanding the working fluid in the piston cylinder to drive the piston In at least one embodiment of the method of operating the engine, the pressurized, non-combustible, working fluid is a supercritical fluid.

In at least one embodiment of the method of operating the engine, the supercritical fluid is supercritical carbon dioxide.

In at least one embodiment of the method of operating the engine, the engine further comprises a crosshead; a piston rod; and a connecting rod; wherein the piston rod connects the piston and the crosshead; and wherein the connecting rod connects the crosshead and the crankshaft.

In at least one embodiment of the method of operating the engine, the intake valve has a valve stem and a flywheel follower; and opening the intake valve with the cam lobe of the rotating flywheel is performed while the flywheel follower follows the circumferential profile of the flywheel as the flywheel rotates with the crankshaft.

In at least one embodiment, a method of operating a reciprocating piston engine is provided, which comprises obtaining the engine, the engine comprising an engine block having a piston cylinder; a piston disposed in the piston cylinder; an intake port to the piston cylinder; an intake valve to open and close the intake port to the piston cylinder; a rotatable crankshaft; a flywheel connected to the crankshaft which is rotatable with the crankshaft, the flywheel having a circumferential profile; and a cam lobe forming a portion of the circumferential profile of the flywheel, wherein, during rotation of the crankshaft, the cam lobe acts on the intake valve to open the intake valve; rotating the crankshaft and the flywheel; opening the intake valve with the cam lobe of the rotating flywheel; introducing a combustible fuel into the piston cylinder while the intake valve is opened; igniting the combustible fuel in the piston cylinder; and combusting the combustible fuel in the piston cylinder to drive the piston.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
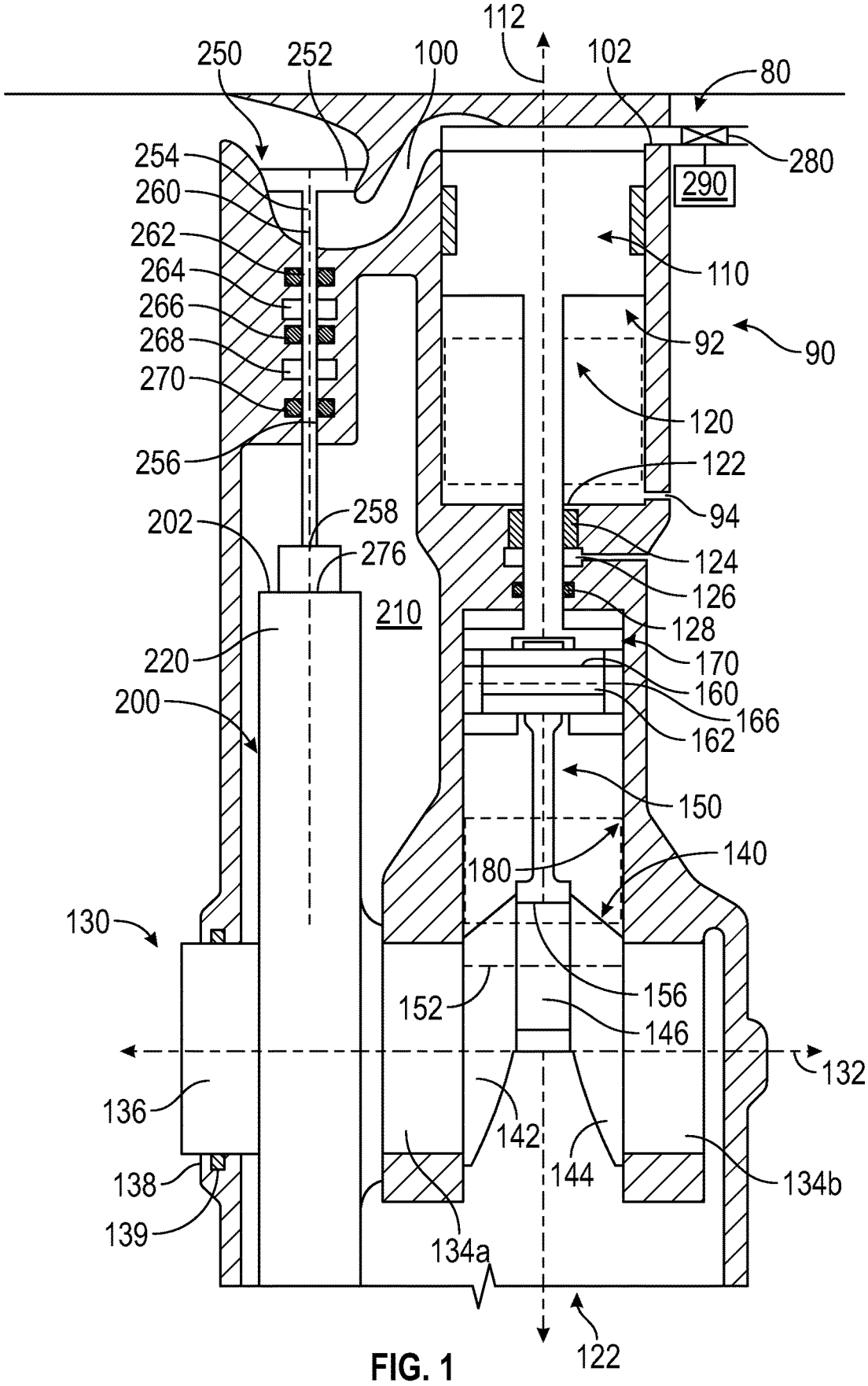
FIG. 1 is a cross-sectional view of an engine according to the present disclosure.

It may be appreciated that the present disclosure is not limited in its application to the details of construction and the arrangement of components set forth in the following description or illustrated in the drawings. The invention(s) herein may be capable of other embodiments and of being practiced or being carried out in various ways. Also, it may be appreciated that the phraseology and terminology used herein is for the purpose of description and should not be regarded as limiting as such may be understood by one of skill in the art.

Figure 2:
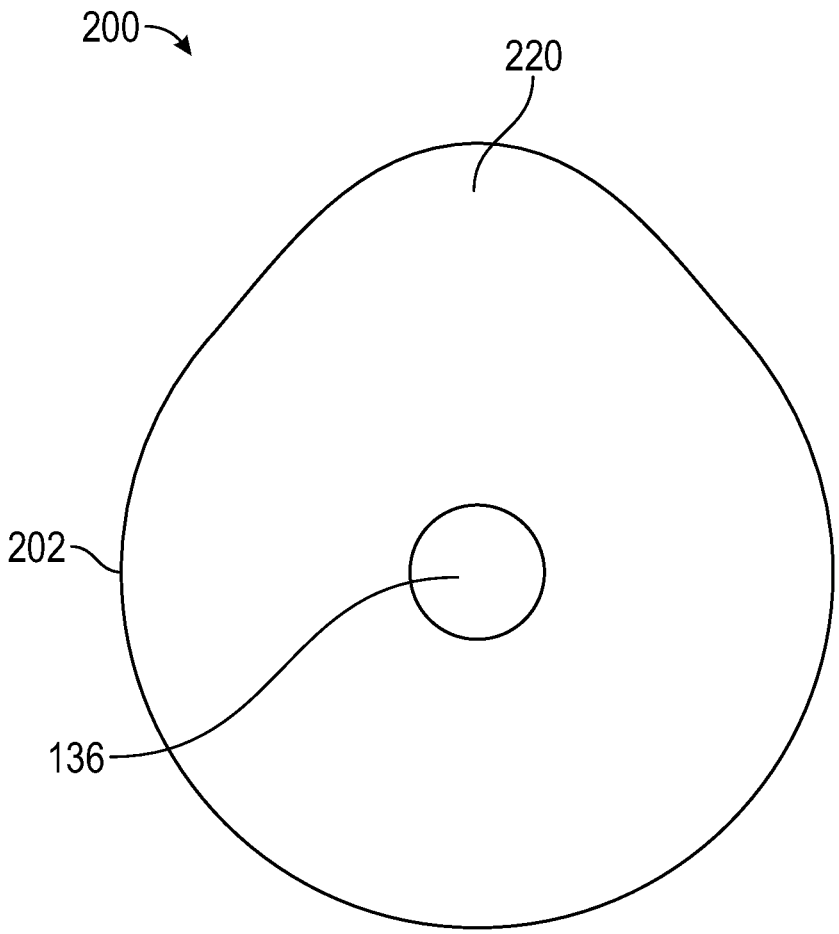
FIG. 2 is a plan view of a flywheel of the engine with a cam lobe.

Referring to FIGS. 1 and 2, there is shown an engine 80. As used herein, an engine 80 may be understood as a machine which converts one or more forms of energy into mechanical energy. More particularly, engine 80 may be a pneumatic (compressed air) engine, such as a volumetric reciprocating piston engine, which also may be referred to as a volumetric reciprocating expander or a non-combustion piston expander.

As shown, engine 80 is a two-stroke (working cycle) reciprocating piston engine. Even more particularly, engine 80 operates with a non-flammable/non-combustible (inert) pressurized working fluid, particularly in a form of a supercritical fluid, which partially depressurizes during the working cycle, with the pressurization providing the driving force for driving the piston(s). A supercritical fluid may be understood to be at a pressure above its critical pressure and at a temperature above its critical temperature. The supercritical working fluid may comprise, essentially consists of or consists of carbon dioxide ($CO_2$). As such, it may be understood that the engine 80 operates without a combustible fuel, or combustion of such fuel.

As shown, engine 80 comprises an engine block 90. Within engine block 90, there are one or more (power) piston cylinders 92, which each contain a respective (power) piston 110. Thus, engine 80, may comprise, for example, an odd or even number of piston cylinders 92/pistons 110, such as one, two, three, four or five cylinders 92/pistons 110, which may all be aligned in a center longitudinal axis thereof in a common plane. The piston cylinder(s) 92/piston(s) 110/may be understood to be particularly configured to operate with the working fluid introduced therewith. During operation, as explained in greater detail below, the piston(s) 110 move exclusively with linear motion along longitudinal axis of travel/displacement 112.

Each piston 110 is connected to a top of a crosshead 170 by a piston rod 120, respectively. Piston rod 120 travels in a piston rod bore (linear cylindrical through-bore) 122 formed in the engine block 90. Similar to the piston(s) 110, the piston rod(s) 120 and crosshead(s) 170 move exclusively with linear motion along axis of travel/displacement 112.

The working fluid for each piston cylinder 92 is introduced into the piston cylinder 92 through an intake (inlet) port 100, and removed from the cylinder through an exhaust (outlet) port 102. Working fluid loss through piston rod bore 122 and possibly into the cavity 210 of the crankcase of the engine block 90, is inhibited by a piston rod seal 124 disposed at the bottom of piston cylinder 92.

As shown, engine 80 further comprises a crankshaft 130. Crankshaft 130 may be understood to comprise a plurality of journals, which may comprise a first main (bearing) journal 134*a* and a second main (bearing) journal 134*b*. Among other things, the main journals 134*a*/134*b* serve as support locations for one or more cranks 140 of the crankshaft 130 and a center axis of rotation 132 for the crankshaft 130. As shown, each crank 140 is disposed between adjacent main journals 134*a*/134*b*. Also as shown, the center axis of rotation 132 for the crankshaft 130 is transverse to the axis of travel/displacement 112 for the piston(s) 110, piston rod(s) 120, and crosshead(s) 170.

Each crank 140 of the crankshaft 130 comprises two crank arms 142 and 144 separated by a connecting rod (bearing) journal 146 (which may also be referred to as a crank pin or crankpin journal). The connecting rod journal 146 of the crankshaft 130 is disposed in a cylindrical opening 156 at the big (crank) end of a connecting rod 150, which may be lined with a fluid film bearing formed by two semi-circular bearing halves, forming a removable cylindrical sleeve. With the foregoing structure, the connecting rod journal 146 of the crankshaft 130 and the connecting rod 150 are pivotable relative to one another about longitudinal axis 152, which is parallel with the center axis of rotation 132 for the crankshaft 130.

As shown each connecting rod journal 146 of the crank 140 is radially offset from the main journals 134*a*/134*b*. The distance of the offset between the connecting rod journal 146 and the main journals 134*a*/134*b* may be referred to as the crank-throw. On some crankshafts 130, part of the crank arms 142, 144 of the crankshaft 130 may extend beyond the main journals 134*a*/134*b* to form counterweights.

While the big (crank) end of the connecting rod 150 is connected to the crankshaft 130, the small (piston) end of the connecting rod 150 is connected to a crosshead 170, which is disposed in a crosshead guide 180.

At the small (piston) end of the connecting rod 150, the connecting rod 150 comprises a cylindrical opening 160, which may be lined with a bushing/bearing, within which a piston pin 162 is disposed (which may also be referred to as a wrist pin or gudgeon pin), which is connected at opposing ends to the crosshead 170. With the foregoing structure, the connecting rod 150 and piston pin 162 are pivotable relative to each other about longitudinal axis 166, which is parallel with longitudinal axis 152 and the center axis of rotation 132 for the crankshaft 130.

In the foregoing manner, the connecting rod 150 converts linear reciprocating movement of the crosshead 170 into circular (rotational) motion, with the connecting rod 150 pivoting through a pivot angle range relative to the axis of travel/displacement 112. More particularly, the crosshead 170 is used to eliminate sideways pressure on the piston 110 (caused by the piston pin 162 moving side to side with the rotation of the crankshaft 130), with the connecting rod 146 able to pivot outside of the piston cylinder 92. The piston rod 120 is attached to the piston 110 and crosshead 170, which move with linear motion, however the crosshead 170 absorbs the transverse forces applied by the rotating crankshaft 130 and not the piston 110.

Engine 80 further comprises a flywheel 200, which 200 is contained within flywheel cavity 210 within the engine block 90. Flywheel 200 is coupled with the crankshaft 130 and rotates with the crankshaft 130 about the center axis of rotation 132. As shown, flywheel 200 is located on a flywheel shaft 136, which is coupled to and rotates with the crankshaft 130. The flywheel shaft 136 may be formed as a single unitary (monolithic) piece with the crankshaft 130, or may engage with the flywheel 200 via a mechanical joint. An end region of the flywheel shaft 136 may be disposed in a shaft support 138, which may comprise a cylindrical bore formed in the engine block 90, such as a blind-bore or a through-bore (as shown), which may provide a sealing land 139, which seals with the shaft 136.

Flywheel 200 includes a cam lobe 220 and hence, the circumferential profile 202 of the flywheel 200 does not have a uniform (constant) diameter, which is defined in part by the cam lobe 220. Preferably, the flywheel 200 with the cam lobe 220 are provided from a single unitary (monolithic) piece of metal, and not multiple pieces of metal joined together.

Engine 80 further comprises an intake valve 250 within intake port 100, which opens and closes access to piston cylinder 92. As shown, the intake valve 250 has a circular head 252 and a cylindrical stem 254, with the stem 254 extending through a valve stem bore (linear cylindrical through-bore) 256 in the engine block 90. Thus, the intake valve 250 is mounted in the engine block 90 (as opposed to a cylinder head).

Disposed at the valve end 258 (oppose the valve head 252) of the intake valve 250 is a flywheel follower 276, which follows the circumferential profile 202 of the flywheel 200 as the flywheel 200 rotates with the crankshaft 130. As shown, the exclusive linear motion of the intake valve 250 along the longitudinal axis of travel/displacement 260 is parallel with the axis of travel/displacement 112 of for the piston(s) 110, piston rod(s) 120, and crosshead(s) 170.

With the foregoing arrangement, the intake valve 250 is arranged in cavity 210 along one side of the piston(s) 112, and operated by the flywheel follower 276 following the circumferential profile 202 of the cam lobe 220 of the flywheel 200. When the flywheel follower 276 comes into contact with the cam lobe 220 of the flywheel 200, the cam lobe 220 pushes the stem 254 of the intake valve 250 upwards to open the intake valve 250. Thus, the operation of the intake valve 250 is exclusively mechanical. Moreover, operation of the intake valve 250 is direct to the circumferential profile 202 of the cam lobe 220 of the flywheel 200 without need for additional operational components such as, for example, a camshaft, pushrod(s), and rocker arm(s).

Engine 80 further comprises an exhaust valve 280 within exhaust port 102, which may be a solenoid controlled exhaust valve, which is opened and closed by a solenoid 290.

As set forth above, engine 80 is shown as a two-stroke (or two-stroke working cycle) engine. The two-strokes may be referred to as the intake (down) stroke and the exhaust (up) stroke. The intake stroke may be understood to begin with the piston 110 at top dead center TDC position and the crankshaft has a crank angle A of zero (crankshaft angle) degrees (0°), when the piston 110 is farthest away from the axis of rotation 132 of the crankshaft 130, and ending with the piston 110 at the bottom dead center BDC position and the crankshaft has a crank angle A of one-hundred eighty degrees (180°) past top dead center TDC, when the piston 110 is closest to the axis of rotation 132 of the crankshaft 130. Conversely, the upward stroke may be understood to begin with the piston 110 at Bottom Dead Center BDC position, when the piston 110 is closest to the axis of rotation 132 of the crankshaft 130, and ending with the piston 110 at the Top Dead Center (TDC) position and the crankshaft has a crank angle A of three-hundred sixty degrees (360°) past top dead center TDC, when the piston 110 is farthest away from the axis of rotation 132 of the crankshaft 130.

With the foregoing engine 80, cam lobe 220 of the flywheel 200 may have a circumferential profile which pushes the flywheel follower 276 and the intake valve 250 upwards such that the intake valve 250 opens intake port 100 to piston cylinder 92. The open period may be measured in units of time, and correspond to the period the intake valve 250 begins to open until the intake valve 250 is finished closing. The open period may also be measured in units of degrees of crankshaft rotation, such as by a crank angle A, about the axis of rotation 132.

Introduction of the pressurized working fluid into the piston cylinder 92 may begin during the intake stoke. Similarly, the open period should end (intake valve 250 is finished closing) during the intake stroke. During the period in which the intake valve 250 is open, the exhaust valve 280 is closed to prevent loss of the pressurized working fluid.

During the open period, pressurized working fluid may flow past the intake valve 250 in the intake port 100 to the piston cylinder 92. The pressurized working fluid may flow into the piston cylinder 92 under an input pressure.

When the pressurized working fluid is introduced into the piston cylinder 92, the intake valve 250 may then be closed (along with the exhaust valve 280) and the force of the expansion of the pressurized working fluid drives the piston 110 downward during the intake stroke towards the bottom dead center BDC position to rotate the crankshaft 130.

Conversely, removal of the pressurized working fluid from the piston cylinder 92 may begin via opening the exhaust valve 280 during the exhaust stroke, particularly when the piston 110 is proximate bottom dead center BDC.

During the open period for exhaust valve 280, the working fluid may flow out of and exit the piston cylinder 92 under while such is still a supercritical fluid at an output pressure lower than the input pressure. Once the working fluid leaves the engine 80, such may be collected as part of a closed loop process for subsequent processing to re-raise the pressure back to the input pressure.

In an event a small amount of the pressurized working fluid is able to undesirably leak past piston 110, such as between the piston 110 and the wall of piston cylinder 92, cylinder 92 includes a cylinder vent 94 to permit the pressurized working fluid to escape from the cylinder 92. The working fluid may be collected as part of a closed loop process for subsequent processing to re-raise the pressure back to the input pressure.

As set forth, above, working fluid loss through piston rod bore 122 in inhibited by piston rod seal 124 disposed around the piston rod 120 at the bottom of piston cylinder 92. However, in an event that all the pressurized working fluid does not properly exit cylinder 92 through cylinder vent 94 and is able to flow past piston rod seal 124, engine 80 further includes a piston rod bore vent 126 beneath piston rod seal 124 for escape of the working fluid, which is followed by a second piston rod (o-ring) seal 128 to inhibit working fluid from entering the crankcase. The working fluid may be collected as part of a closed loop process for subsequent processing to re-raise the pressure of the fluid back to the input pressure.

Similarly, in order to inhibit the working fluid from entering the cavity 210 of the crankcase of the engine block 90 via valve stem 254, engine 80 comprises a valve stem first seal 262 followed by a first valve stem bore vent 264 and a subsequent valve stem second seal 266. In an event that any pressurized working fluid flows past valve stem seal 262, does not properly exit valve stem bore 260 through valve stem bore vent 264 and is able to flow past piston rod seal 266, engine 80 further includes a second valve stem bore vent 268 followed by another valve stem third seal 270 to inhibit working fluid from entering the crankcase. The working fluid may be collected as part of a closed loop process for subsequent processing to re-raise the pressure of the fluid back to the input pressure.

Figure 3:
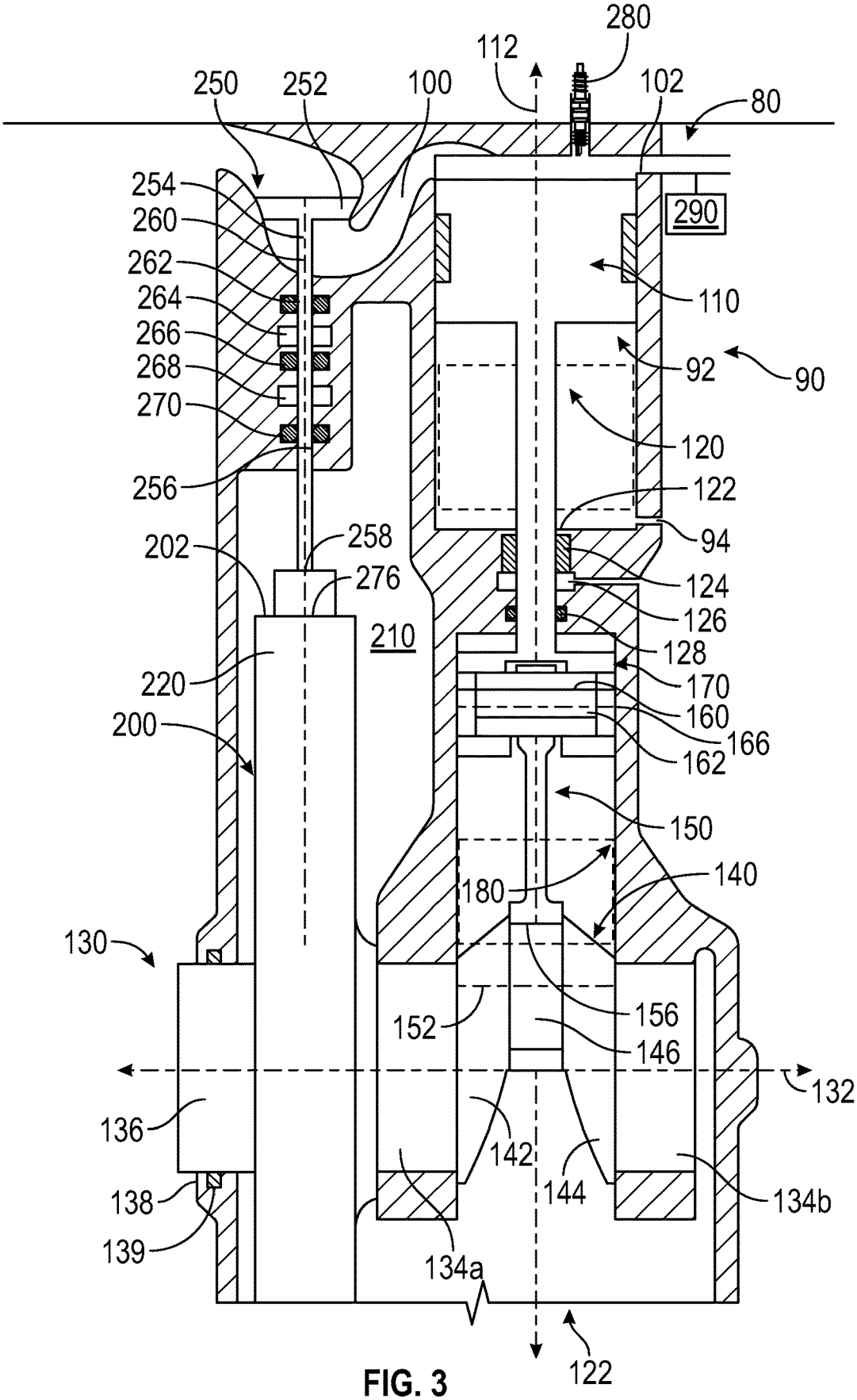
FIG. 3 is a cross-sectional view of another engine according to the present disclosure.

Referring to FIG. 3, in other embodiments, engine 80 may be an internal combustion engine, such as a two-stroke engine, which may be powered by a combustible fuel, such as gasoline or diesel fuel. In such situation, the combustible fuel would be introduced to the piston cylinder 92 during the intake stroke, ignited and combusted (with an oxidant, e.g. oxygen), after which the products of combustion removed from the piston cylinder 92 during the exhaust stroke.

While a preferred embodiment of the present invention(s) has been described, it should be understood that various changes, adaptations and modifications can be made therein without departing from the spirit of the invention(s) and the scope of the appended claims. The scope of the invention(s) should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed, or that all recited features are necessary.

LIST OF REFERENCE CHARACTERS

80 engine
90 engine block
92 piston cylinder
94 cylinder vent
100 intake (inlet) port
102 exhaust (outlet) port
110 piston
112 axis of travel/displacement
120 piston rod
122 piston rod bore
124 piston rod seal
126 piston rod bore vent
128 piston rod seal
130 crankshaft
132 axis of rotation
134*a* first main (bearing) journal
134*b* second main (bearing) journal
136 flywheel shaft
138 shaft support
139 sealing land
140 crank
142 crank arm
144 crank arm
146 connecting rod (bearing) journal
150 connecting rod
152 longitudinal axis of journal
156 cylindrical (big end) opening of connecting rod
160 cylindrical (small end) opening of connecting rod
162 piston (wrist gudgeon) pin
166 longitudinal axis of pin
170 crosshead
180 crosshead guide
200 flywheel
202 circumferential profile
210 flywheel cavity
220 cam lobe
250 intake valve
252 valve head
254 valve stem
256 valve stem bore
258 valve end
260 axis of travel/displacement
262 valve stem seal
264 valve stem bore vent
266 valve stem seal
268 valve stem bore vent
270 valve stem seal
276 flywheel follower
280 exhaust valve
290 solenoid

What is claimed is:

1. A reciprocating piston engine, comprising:
an engine block having a piston cylinder;
a piston disposed in the piston cylinder;
an intake port to the piston cylinder;
an intake valve to open and close the intake port to the piston cylinder;
a rotatable crankshaft;
a flywheel connected to the crankshaft which is rotatable with the crankshaft, the flywheel having a circumferential profile; and
a cam lobe forming a portion of the circumferential profile of the flywheel, wherein, during rotation of the crankshaft, the cam lobe acts on the intake valve to open the intake valve.

2. The reciprocating piston engine of claim 1, wherein:
the reciprocating piston engine operates with a pressurized, non-combustible, working fluid.

3. The reciprocating piston engine of claim 2, wherein:
the working fluid is in a supercritical fluid.

4. The reciprocating piston engine of claim 3, wherein:
the supercritical fluid is supercritical carbon dioxide.

5. The reciprocating piston engine of claim 1, wherein:
the reciprocating piston engine has a two-stroke working cycle having an intake stroke and an exhaust stroke.

6. The reciprocating piston engine of claim 5, wherein:
the cam lobe acts on the intake valve to open the intake valve when the two-stroke working cycle is in the intake stroke.

7. The reciprocating piston engine of claim 5, wherein:
the cam lobe acts on the intake valve to close the intake valve when the two-stroke working cycle is in the exhaust stroke.

8. The reciprocating piston engine of claim 1, further comprising:
a crosshead;
a piston rod;
a connecting rod;
wherein the piston rod connects the piston and the crosshead; and
wherein the connecting rod connects the crosshead and the crankshaft.

9. The reciprocating piston engine of claim 1, wherein:
the intake valve having a valve stem and a flywheel follower; and
wherein the flywheel follower follows the circumferential profile of the flywheel as the flywheel rotates with the crankshaft.

10. The reciprocating piston engine of claim 1, wherein:
the flywheel and the cam lobe are provided from a single unitary piece of metal.

11. The reciprocating piston engine of claim 1, wherein:
the reciprocating piston engine is a reciprocating piston non-combustion expander engine.

12. The reciprocating piston engine of claim 1, wherein:
the reciprocating piston engine is a reciprocating piston combustion engine.

13. A method of operating a reciprocating piston engine, comprising:

obtaining the engine, the engine comprising
- an engine block having a piston cylinder;
- a piston disposed in the piston cylinder;
- an intake port to the piston cylinder;
- an intake valve to open and close the intake port to the piston cylinder;
- a rotatable crankshaft;
  - a flywheel connected to the crankshaft which is rotatable with the crankshaft, the flywheel having a circumferential profile; and
- a cam lobe forming a portion of the circumferential profile of the flywheel, wherein, during rotation of the crankshaft, the cam lobe acts on the intake valve to open the intake valve;

rotating the crankshaft and the flywheel;

opening the intake valve with the cam lobe of the rotating flywheel;

introducing a pressurized, non-combustible, working fluid into the piston cylinder while the intake valve is opened; and expanding the working fluid in the piston cylinder to drive the piston.

14. The method of claim 13, wherein:

the pressurized, non-combustible, working fluid is a supercritical fluid.

15. The method of claim 13, wherein:

the supercritical fluid is supercritical carbon dioxide.

16. The method of claim 13, wherein:

the engine further comprises
- a crosshead;
- a piston rod; and
- a connecting rod;

wherein the piston rod connects the piston and the crosshead; and wherein the connecting rod connects the crosshead and the crankshaft.

17. The method of claim 13, wherein:

the intake valve has a valve stem and a flywheel follower; and opening the intake valve with the cam lobe of the rotating flywheel is performed while the flywheel follower follows the circumferential profile of the flywheel as the flywheel rotates with the crankshaft.

18. A method of operating a reciprocating piston engine, comprising:

obtaining the engine, the engine comprising
- an engine block having a piston cylinder;
- a piston disposed in the piston cylinder;
- an intake port to the piston cylinder;
- an intake valve to open and close the intake port to the piston cylinder;
- a rotatable crankshaft;
- a flywheel connected to the crankshaft which is rotatable with the crankshaft, the flywheel having a circumferential profile; and
- a cam lobe forming a portion of the circumferential profile of the flywheel, wherein, during rotation of the crankshaft, the cam lobe acts on the intake valve to open the intake valve;

rotating the crankshaft and the flywheel;

opening the intake valve with the cam lobe of the rotating flywheel;

introducing a combustible fuel into the piston cylinder while the intake valve is opened;

igniting the combustible fuel in the piston cylinder; and combusting the combustible fuel in the piston cylinder to drive the piston.

19. The method of claim 18, wherein:

the combustible fuel is gasoline.

20. The method of claim 18, wherein:

the combustible fuel is diesel fuel.

* * * * *